US011939120B2

(12) United States Patent
Wang

(10) Patent No.: US 11,939,120 B2
(45) Date of Patent: Mar. 26, 2024

(54) SELF-ERECTING COLLAPSIBLE POLYHEDRON SYSTEM

(71) Applicant: Vincent Wang, Covina, CA (US)

(72) Inventor: Vincent Wang, Covina, CA (US)

(73) Assignee: MAKE IT MINE LLC, Las Vegas, NV (US)

( * ) Notice: Subject to any disclaimer, the term of this patent is extended or adjusted under 35 U.S.C. 154(b) by 0 days.

(21) Appl. No.: 17/711,534

(22) Filed: Apr. 1, 2022

(65) Prior Publication Data

US 2023/0312163 A1 Oct. 5, 2023

(51) Int. Cl.
*B65D 5/36* (2006.01)

(52) U.S. Cl.
CPC ..... *B65D 5/3614* (2013.01)

(58) Field of Classification Search
CPC ..... B65D 5/3614; B65D 5/36; B65D 5/4283; B65D 25/102; G09F 1/08; G09F 1/06; G09F 1/04; G09F 1/00; G09F 15/0025; B42D 15/042
USPC ..... 229/117, 116.1, 117.01, 108.1; 40/124.08, 539; 206/768, 45.28; 220/4.21, 4.28
See application file for complete search history.

(56) References Cited

U.S. PATENT DOCUMENTS 1,499,891 A * 7/1924 Storer ..... G09F 1/06 446/147
3,668,796 A * 6/1972 Patterson ..... G09F 1/06 428/9
4,678,095 A * 7/1987 Barnett ..... B65D 5/36 229/199
4,729,182 A * 3/1988 Sherman ..... G09F 7/22 428/7
4,794,024 A * 12/1988 Crowell ..... G09F 1/06 446/148
4,854,060 A * 8/1989 Corbo ..... A47G 1/141 40/539
5,010,669 A * 4/1991 Moran ..... G09F 1/08 229/92.8
5,096,751 A * 3/1992 Duchek ..... B42D 15/042 40/538
5,317,823 A * 6/1994 Brunt ..... G09F 1/08 40/539
6,497,601 B1 * 12/2002 Ward ..... G09F 1/06 40/124.14

* cited by examiner

*Primary Examiner* — Christopher R Demeree
(74) *Attorney, Agent, or Firm* — Cohen IP Law Group, PC; Michael N. Cohen

(57) ABSTRACT

A collapsible and self-erecting polyhedron system is provided. The system includes a collapsible and self-erecting box. The box comprises cardboard and includes outer surfaces upon which images (e.g., photographic reproductions), graphics, and text are printed to provide a three-dimensional greeting card. The three-dimensional greeting card (the box) is collapsed and placed into an envelope, and upon being removed from the envelope, automatically self-erects providing a fun and exciting experience. Confetti also is included within the box that is ejected during the box self-erecting, thereby providing even more enjoyment.

20 Claims, 23 Drawing Sheets

SELF-ERECTING COLLAPSIBLE POLYHEDRON SYSTEM

FIELD OF THE INVENTION

The present invention relates to greeting cards, including greeting cards that automatically self-erect into three dimensional polyhedrons upon being removed from an envelope.

BACKGROUND

Greeting cards come in all shapes and sizes. The purpose of greeting cards is typically to provide enjoyment to the person receiving and opening the greeting card.

However, because most greeting cards are simple fold-out cards, the excitement generated by receiving such cards has diminished over the years.

Accordingly, there is a need for a self-erecting three-dimensional greeting card to increase the excitement generated when receiving the card.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In general, and according to exemplary embodiments hereof, a collapsible and self-erecting polyhedron system is provided. The polyhedron may be chosen to include a cube so that the system provides a collapsible and self-erecting box. The box may comprise cardboard and may serve a variety of purposes. For example, the self-erecting box may include outer surfaces upon which images (e.g., photographic reproductions), graphics, and text may be printed to provide a three-dimensional greeting card. The three-dimensional greeting card (the box) may be collapsed and placed into an envelope, and upon being removed from the envelope, may automatically self-erect providing a fun and exciting experience. Confetti also may be included within the box that may be ejected during the box self-erecting, thereby providing even more enjoyment.

In some embodiments, the self-erecting collapsible polyhedron system 10 (also referred herein as simply the system 10) includes a three-dimensional polyhedron body 12 comprising a plurality of polygonal faces.

For the purposes of this specification, the system 10 will be described primarily as including a cube-shaped body 12. However, it is understood that the system 10 also may include other types of polyhedron shaped bodies (e.g., other cuboids, hexahedrons, etc.) and that the scope of the system 10 is not limited by the type of polyhedron shaped body that it may include.

Figure 1:
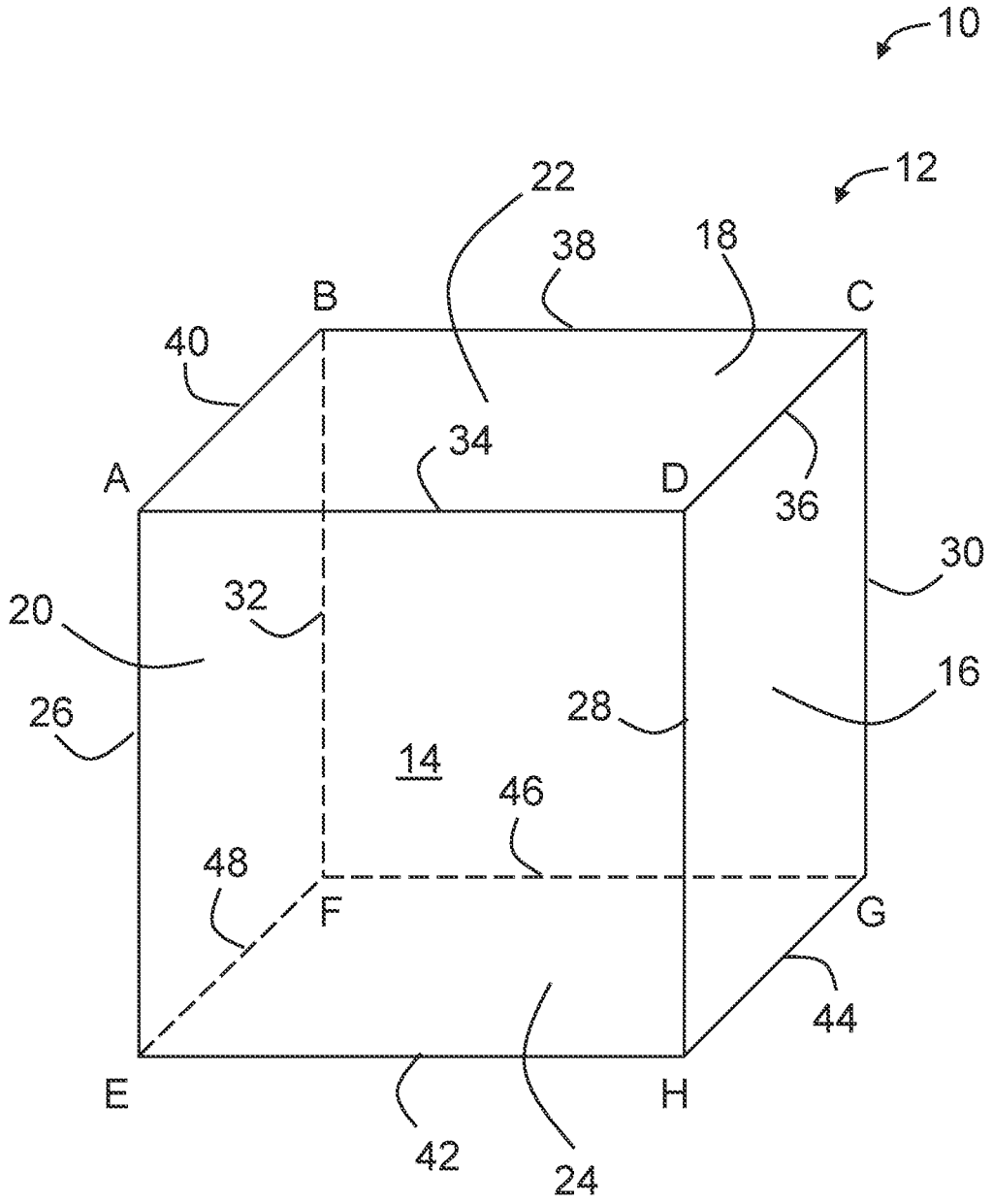
FIG. 1 shows aspects of a self-erecting collapsible polyhedron system according to exemplary embodiments hereof.

In some embodiments, as shown in FIG. 1, the self-erecting collapsible polyhedron system 10 includes a body 12 shaped as a cube comprising six square faces 14, 16, 18, 20, 22, 24, twelve edges 26, 28, 30, 32, 34, 36, 38, 40, 42, 44, 46, 48, and eight vertices A, B, C, D, E, F, G, H. The body 12 preferably comprises a material such as paper, cardboard, plastic, and/or other suitable materials. The twelve edges 26, 28, 30, 32, 34, 36, 38, 40, 42, 44, 46, 48, and eight vertices A, B, C, D, E, F, G, H are generally formed by folds in the material (e.g., in the paper and/or cardboard) and are thereby flexible. In this way, the body 12 may be collapsed and subsequently re-erected to form a cube. This will be described in other sections.

Figure 2:
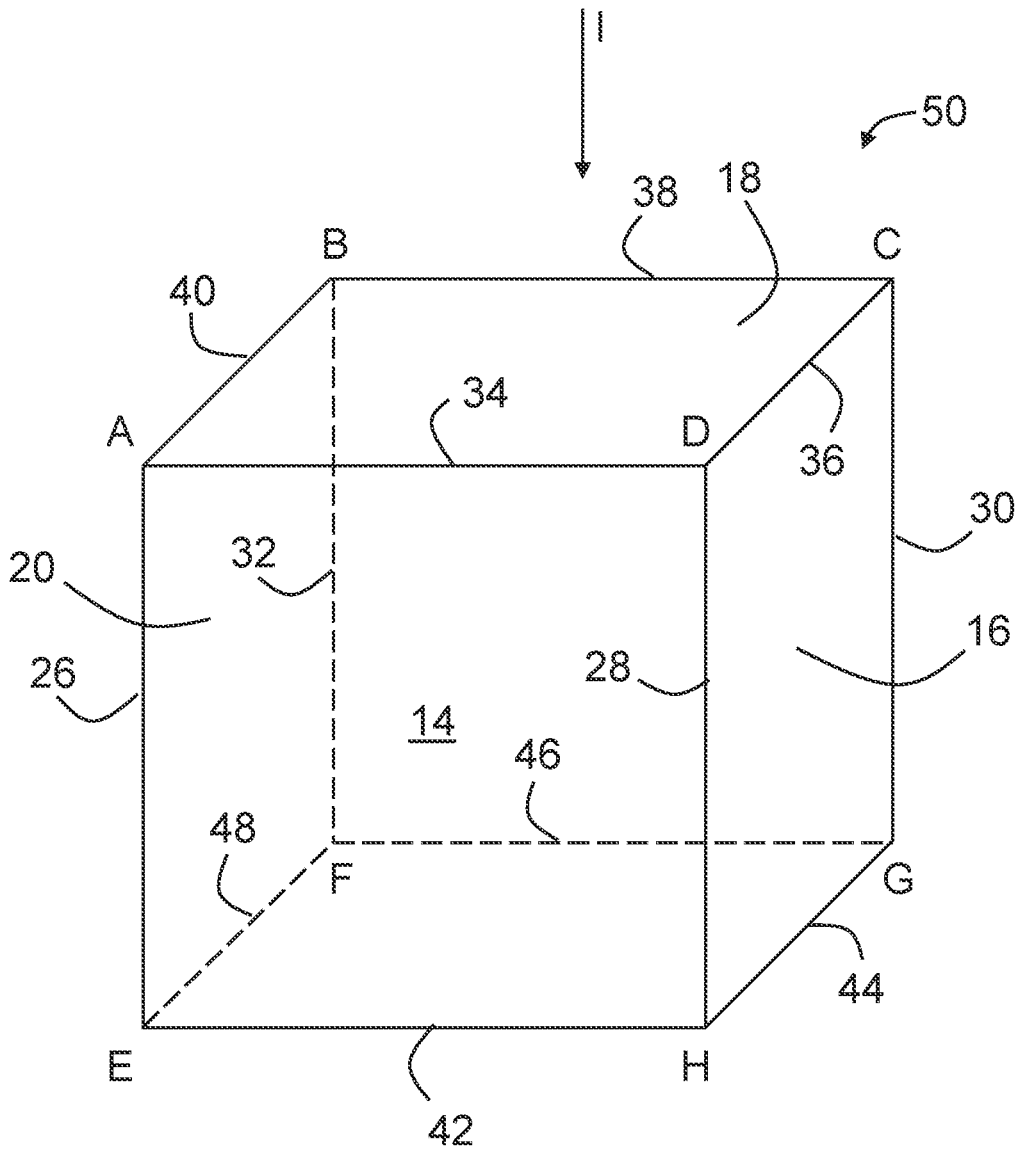
FIGS. 2-7 show aspects of a first portion of a self-erecting collapsible polyhedron system according to exemplary embodiments hereof.
Figure 3:
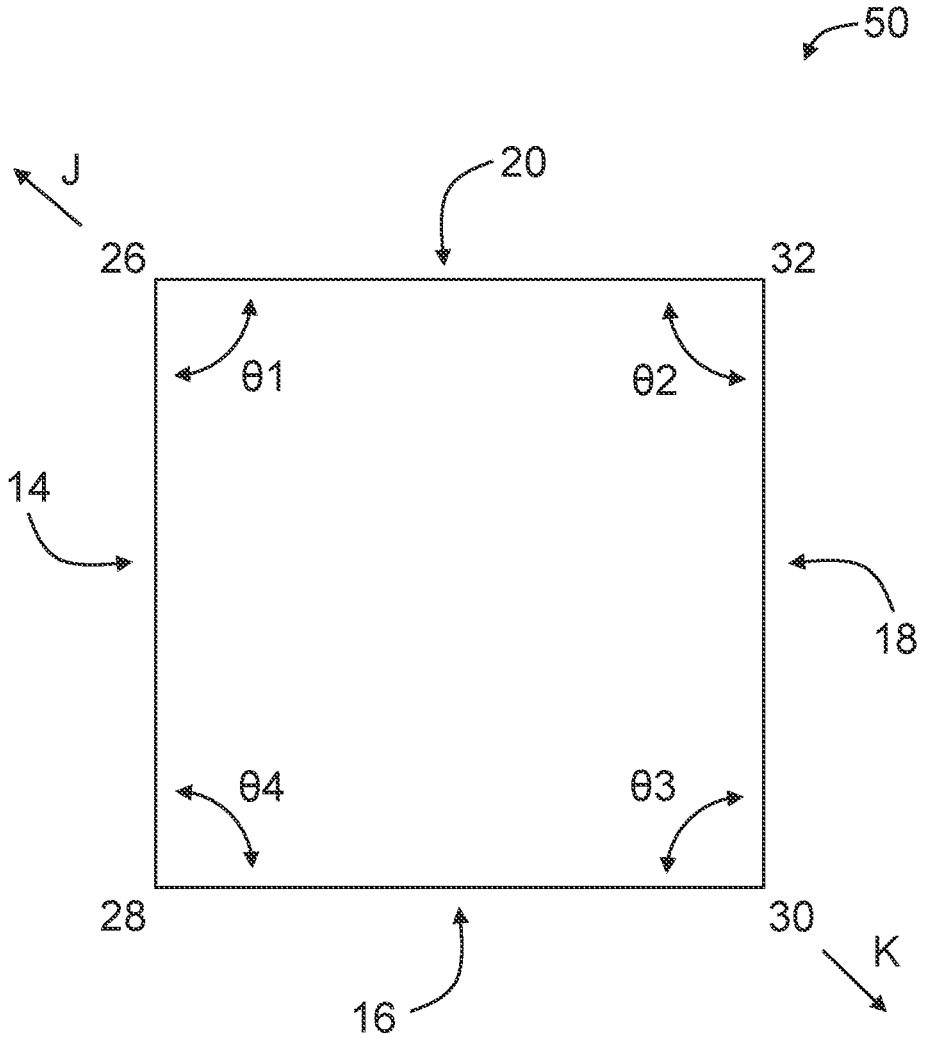

For the purposes of clarity, the system 10 will first be described in relation to a first portion 50 of the body 12 that includes the side faces 14, 16, 18, 20, and the associated side edges 26, 28, 30, 32 that join the side faces 14, 16, 18, 20. This first portion 50 is depicted in FIG. 2. FIG. 3 shows the first portion 50 from the perspective of the arrow I in FIG. 2.

FIG. 3 also depicts the angle θ1 between adjacent side faces 14, 20, the angle θ2 between adjacent side faces 14, 16, the angle θ3 between adjacent faces 16, 18, and the angle θ4 between adjacent side faces 18, 20. With the top-view cross-section of the portion 50 being generally square as shown in FIG. 3, the angles θ1-θ2 are right angles (90°). However, as described herein, because the side edges 26, 28, 30, 32 are flexible, it is understood that the angles θ1-θ4 may be caused to change.

Figure 4:
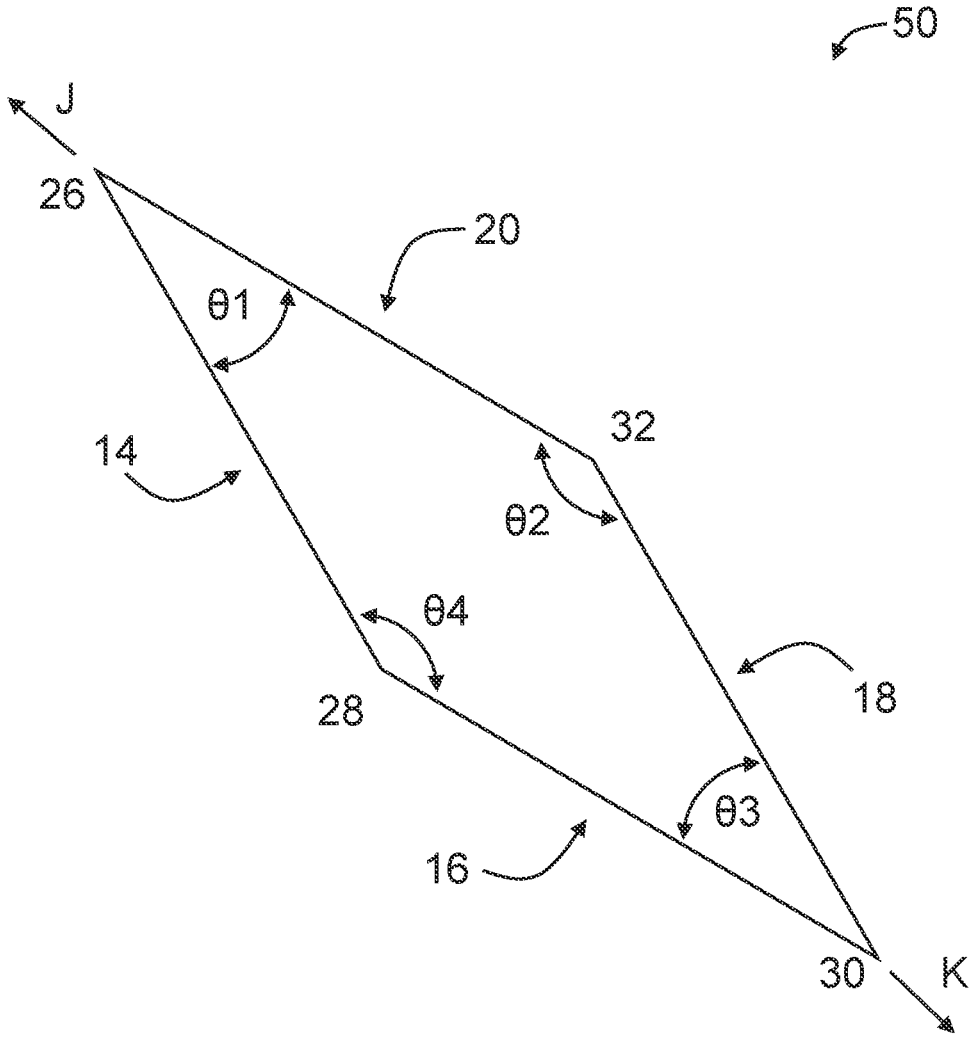

In some embodiments, as shown in FIGS. 2-3, an outward force applied to the edge 26 in the direction of the arrow J, and/or a generally opposing outward force applied to the edge 30 in the direction of the arrow K may cause the angles θ1 and θ3 to decrease and the angles θ2 and θ4 to increase. The result of this is shown in FIG. 4.

Then, as the outward forces in the directions of the arrows J, K are continued, the angles θ1 and θ3 may each approach 0° while the angles θ2 and θ4 may each approach 180°. This is shown in FIG. 5, with the portion 50 generally collapsed.

Figure 5:
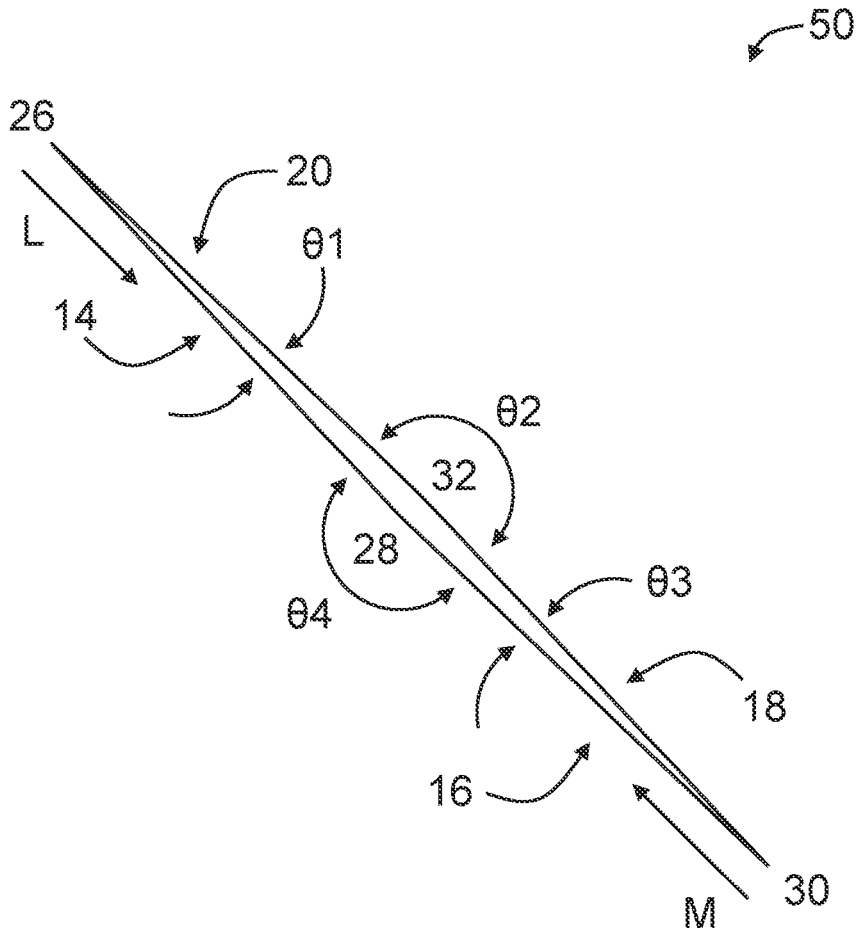
Figure 6:
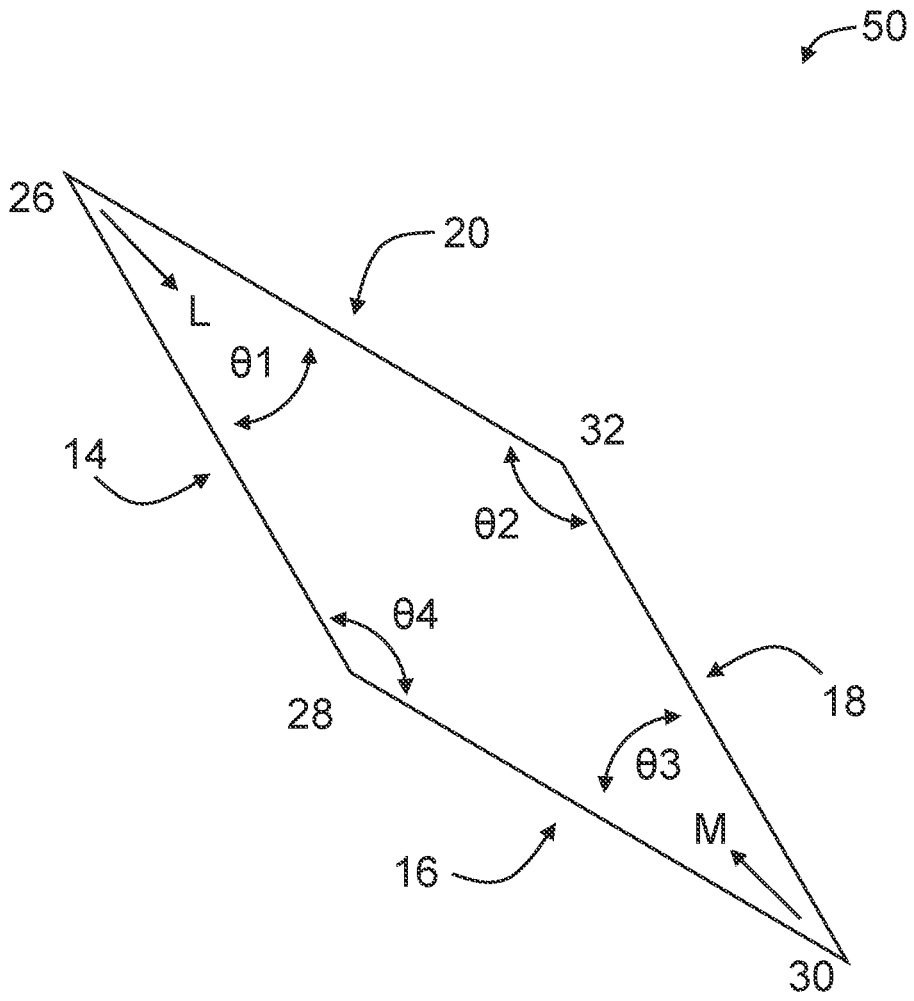

Conversely, inward forces applied to the edges 26, 30 in the directions of the arrows L, M, respectively, in FIG. 5 may cause the angles θ1 and θ3 to increase and the angles θ2 and θ4 to decrease. This is shown in FIG. 6.

Figure 7:
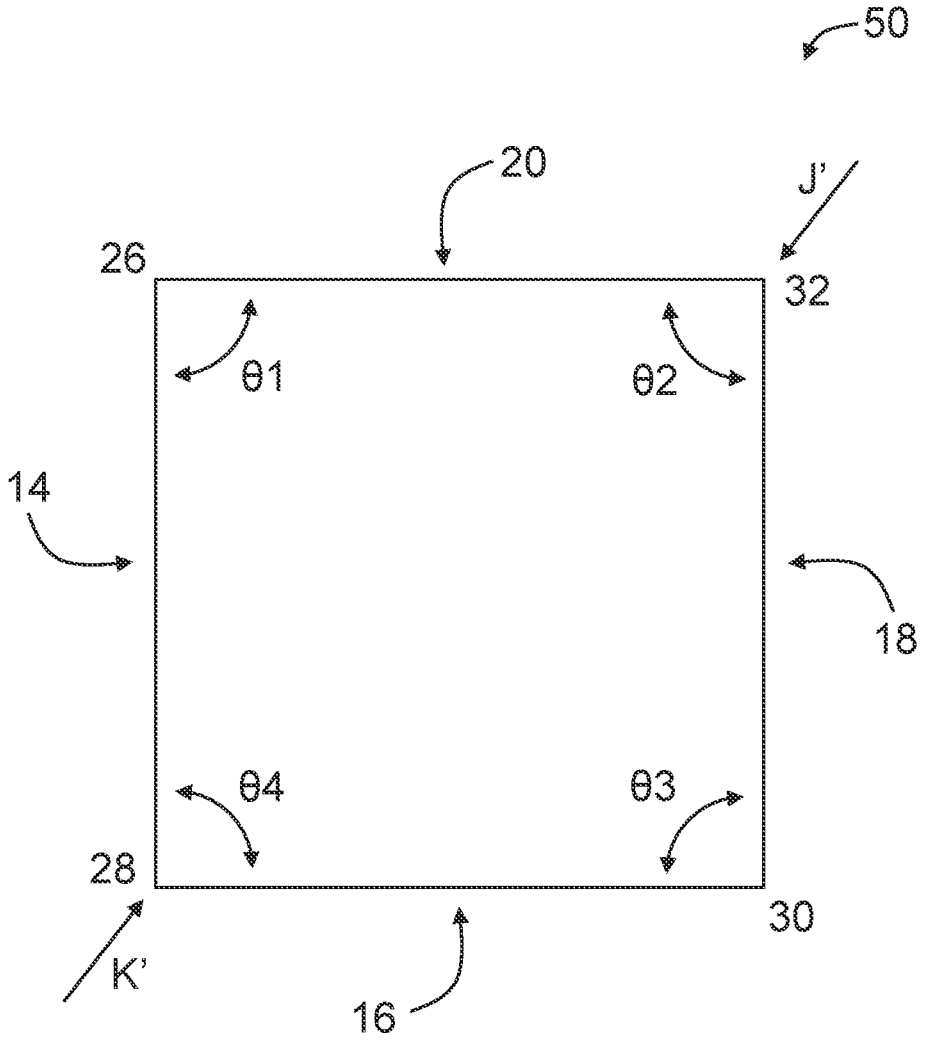

Then, as the inward forces in the directions of the arrows L, M are continued, the angles θ1-θ4 may all approach 90° as shown in FIG. 7 (and the body 12 may be generally re-erected into a cubical form).

Given the above, it is understood that the portion 50 may be generally collapsed (into the configuration shown in FIG. 5) by applying outward forces J, K and generally re-erected (into the configuration shown in FIG. 7) by applying inward forces L, M. Alternatively, it also can be seen that inward forces applied to the edges 28, 32 by forces in the directions of the arrows J', K', respectively, may cause the portion 50 of FIG. 3 to collapse into the arrangement shown in FIG. 5.

Figure 8:
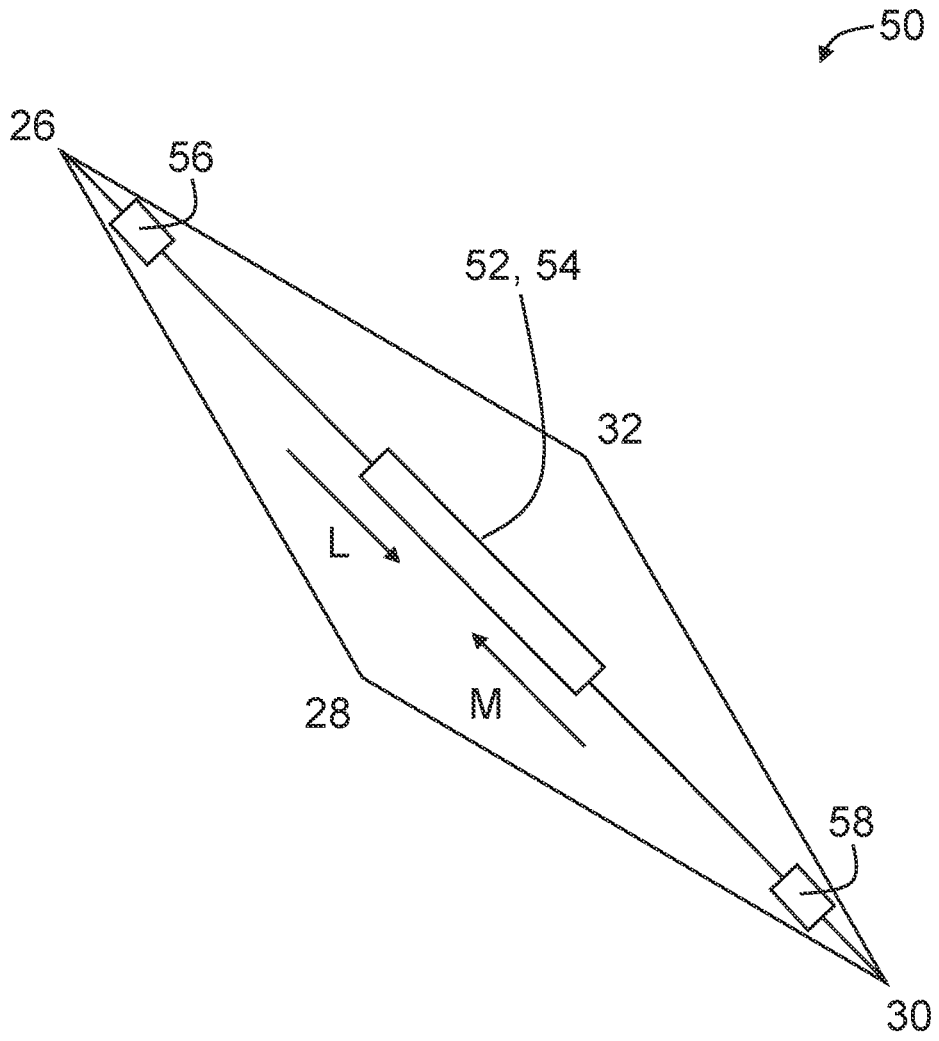
FIGS. 8-9 show aspects of a force mechanism configured with a self-erecting collapsible polyhedron system according to exemplary embodiments hereof.
Figure 9:
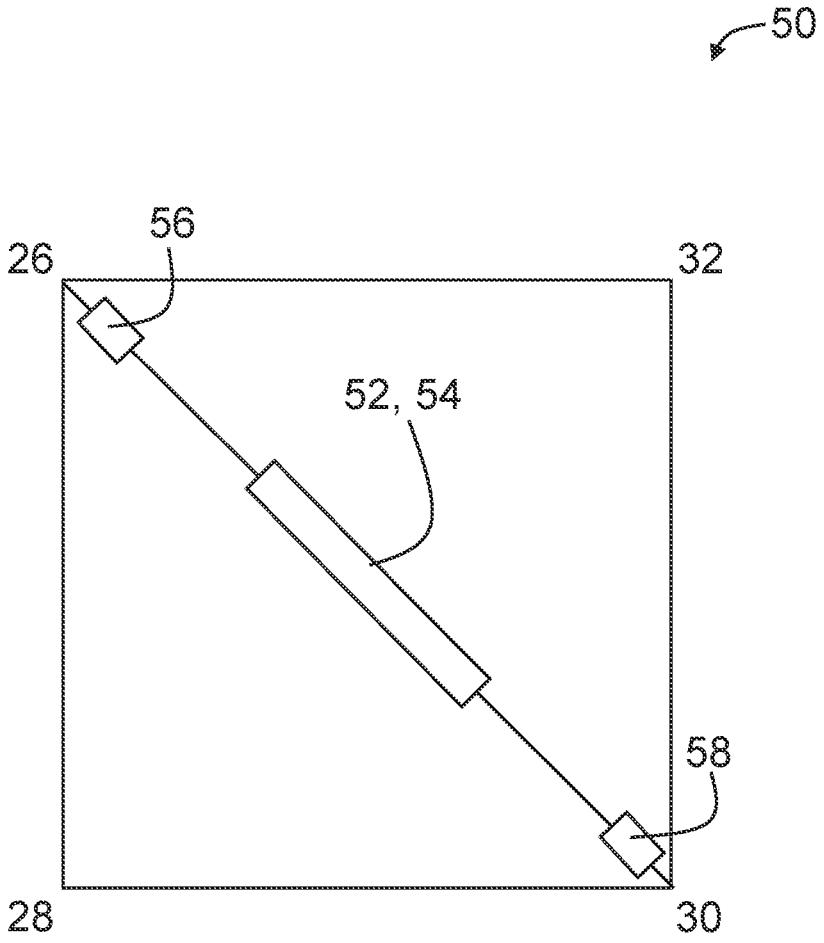

In some embodiments, as shown in FIG. 8, the portion 50 also may include a force mechanism 52 configured between the edge 26 and the edge 30 that may exert an inward force to each edge 26, 30 in the directions of the arrows L, M, respectively. In this way, the force mechanism 52 may cause the collapsed portion 50 of FIG. 8 (and FIG. 5) to transform into the erected portion 50 of FIG. 9 (and FIG. 7).

In some embodiments, the force mechanism 52 includes a spring mechanism 54 such as a section of elastic material (e.g., rubber), a rubber band, a coiled spring, any other type of spring device, and any combinations thereof.

In some embodiments, the spring mechanism 54 (e.g., a rubber band) coupled to the edge 26 via a first connection mechanism 56 and to the edge 30 via a second connection mechanism 58. In some embodiments, the first and second connection mechanisms 56, 58 may comprise hooks, notches, holes, other types of connection mechanisms, and any combinations thereof. For example, in some embodiments, the first and second connection mechanisms 56, 58 may comprise hooks formed from a tab or folded portion of the material that may comprise the body 12 (e.g., cardboard).

The top face 22 and the bottom face 24 will be described next in relation to FIGS. 10-18.

Figure 10:
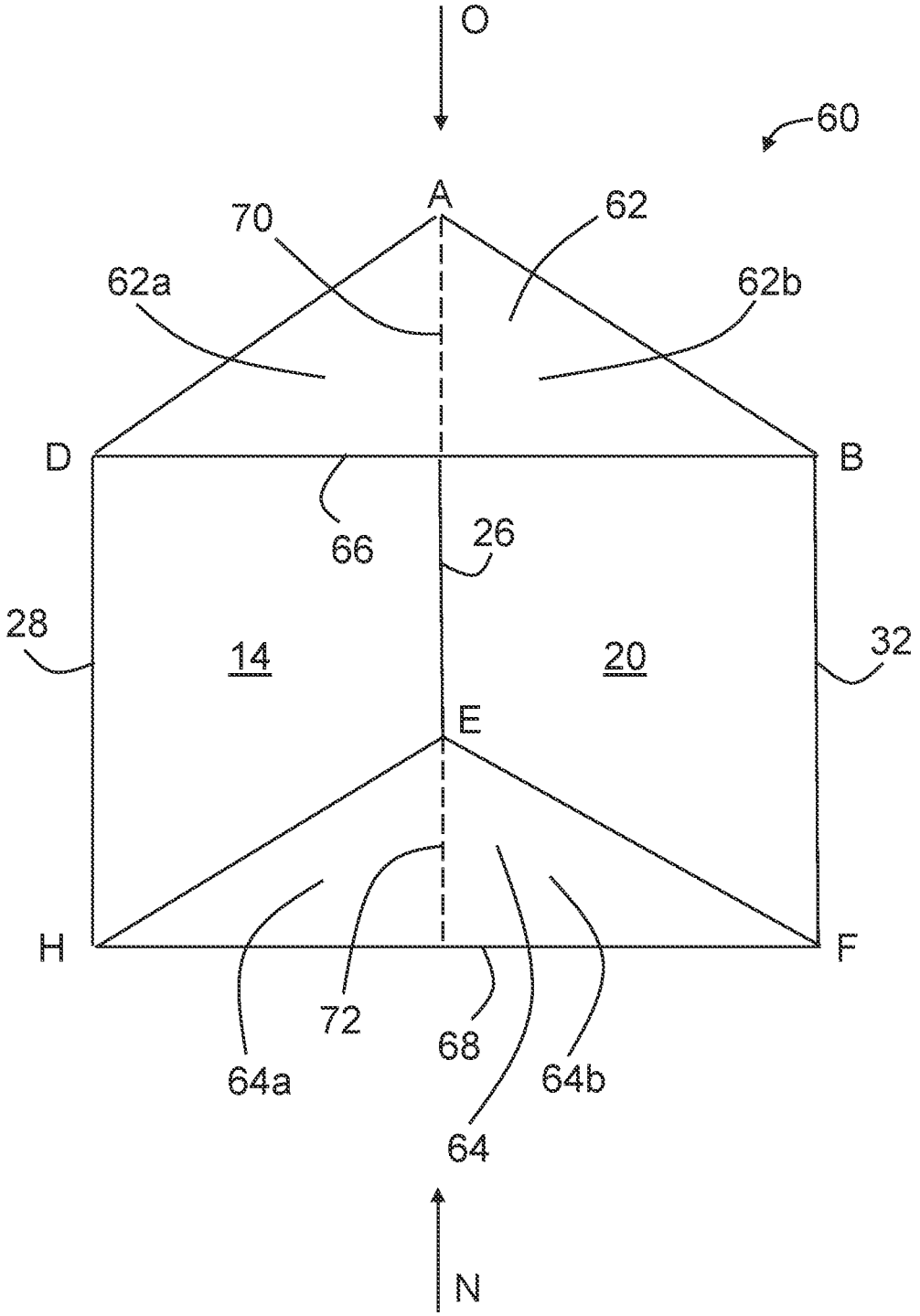
FIGS. 10-17 show aspects of a second portion of a self-erecting collapsible polyhedron system according to exemplary embodiments hereof.

FIG. 10 depicts a second portion 60 of the body 12 comprising side faces 14, 20 joined at edge 26, and including a top face portion 62 and a bottom face portion 64. The top face portion 62 generally includes one-half of the top face 22 resulting from the top face 22 being bisected between vertices B and D to form middle edge 66, and the bottom face portion 64 generally includes one-half of the bottom face 24 resulting from the bottom face 24 being bisected between vertices F and H to form middle edge 68.

In some embodiments, as shown in FIG. 10, the top face portion 62 includes a fold line 70 extending from the vertex A to a midpoint of the middle edge 66 thereby bisecting the top face portion 62 into two top face half portions 62*a*, 62*b*, and the bottom face portion 64 includes a fold line 72 extending from the vertex E to a midpoint of the middle edge 68 thereby bisecting the bottom face portion 64 into two bottom face half portions 64*a*, 64*b*.

Figure 11:
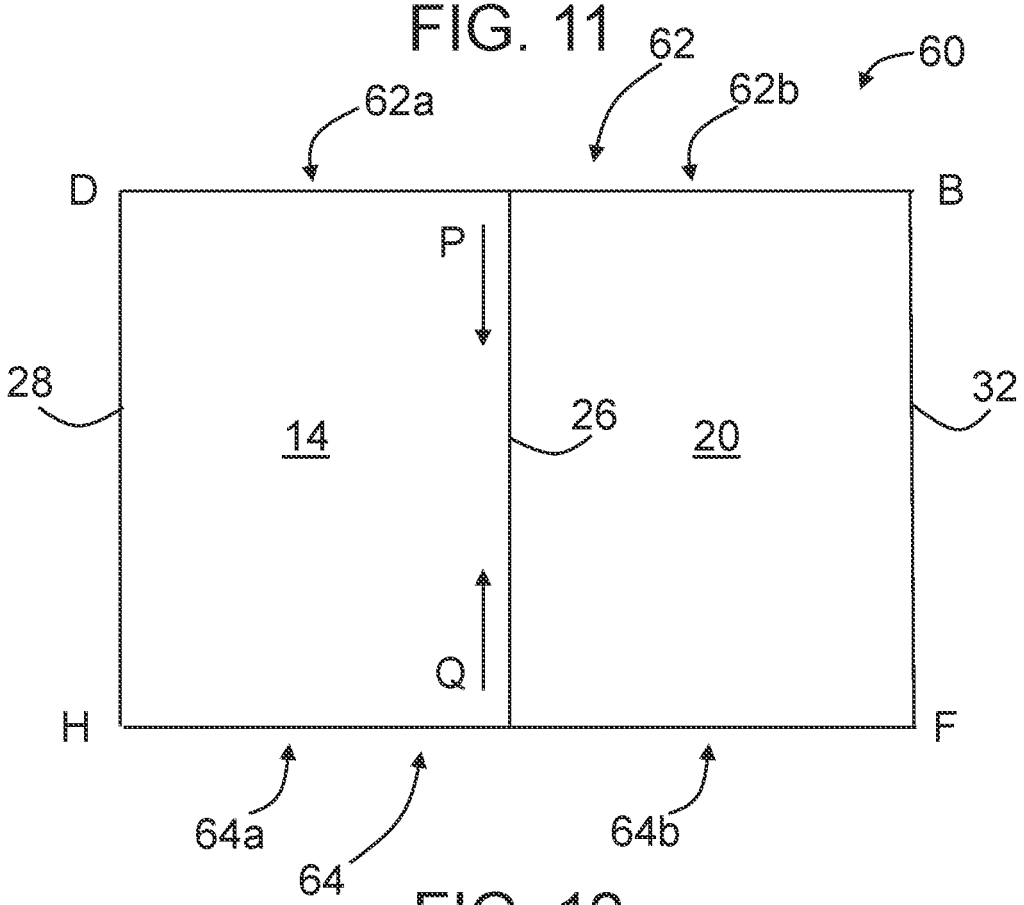
Figure 14:
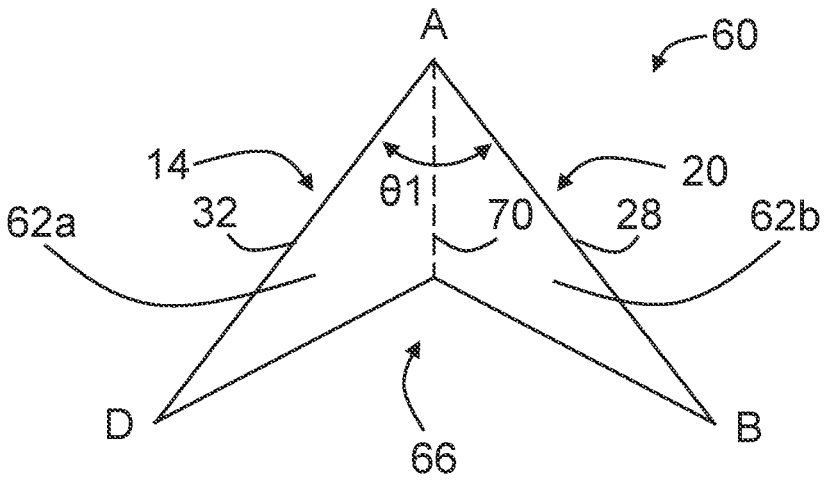
Figure 15:
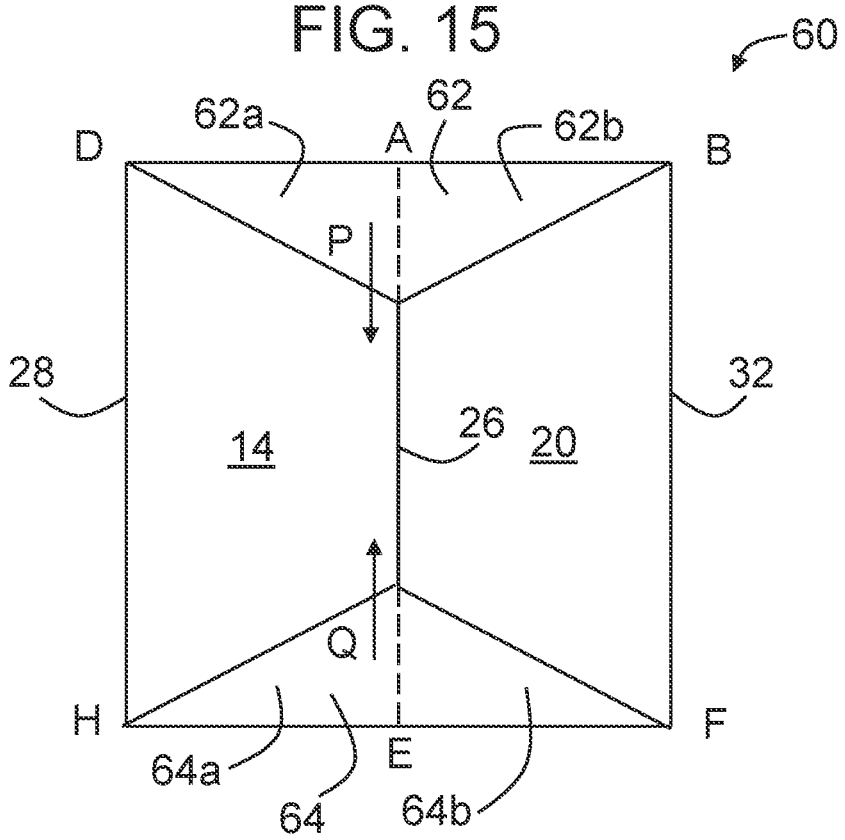
Figure 16:
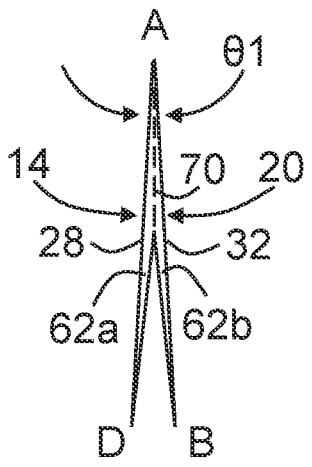
Figure 17:
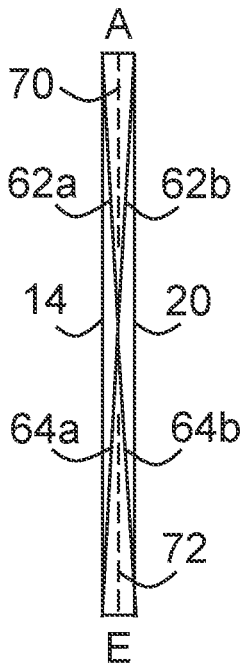

FIGS. 11, 15, 17 shows a front view of the second portion 60 looking directly into the edge 26 from the perspective of the arrow N in FIG. 10, and FIGS. 12, 14, 16 show a top view of the second portion 60 looking straight down from the perspective of the arrow O in FIG. 10. Notably, the angle θ1 of FIG. 12 corresponds to the angle θ1 of FIGS. 3-7.

Figure 12:
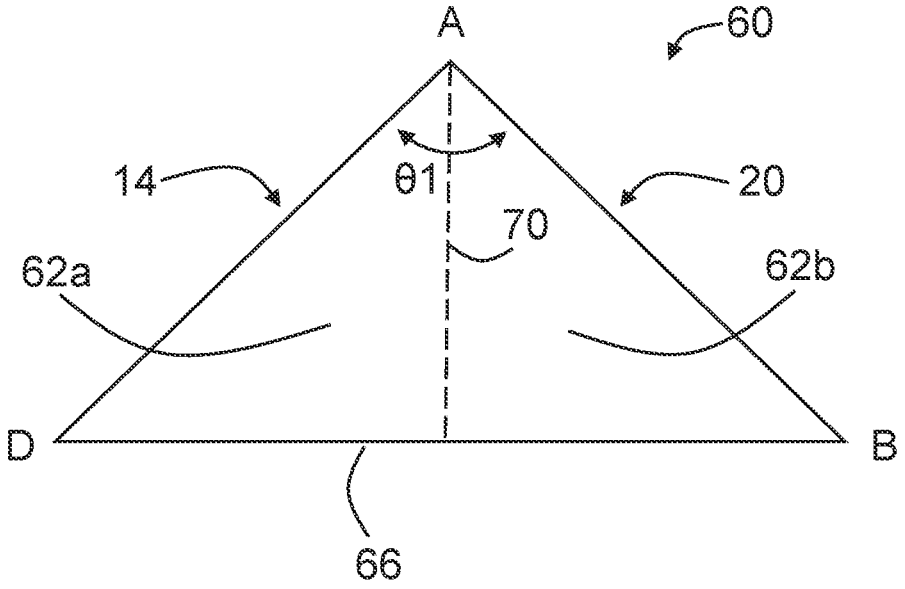
Figure 13:
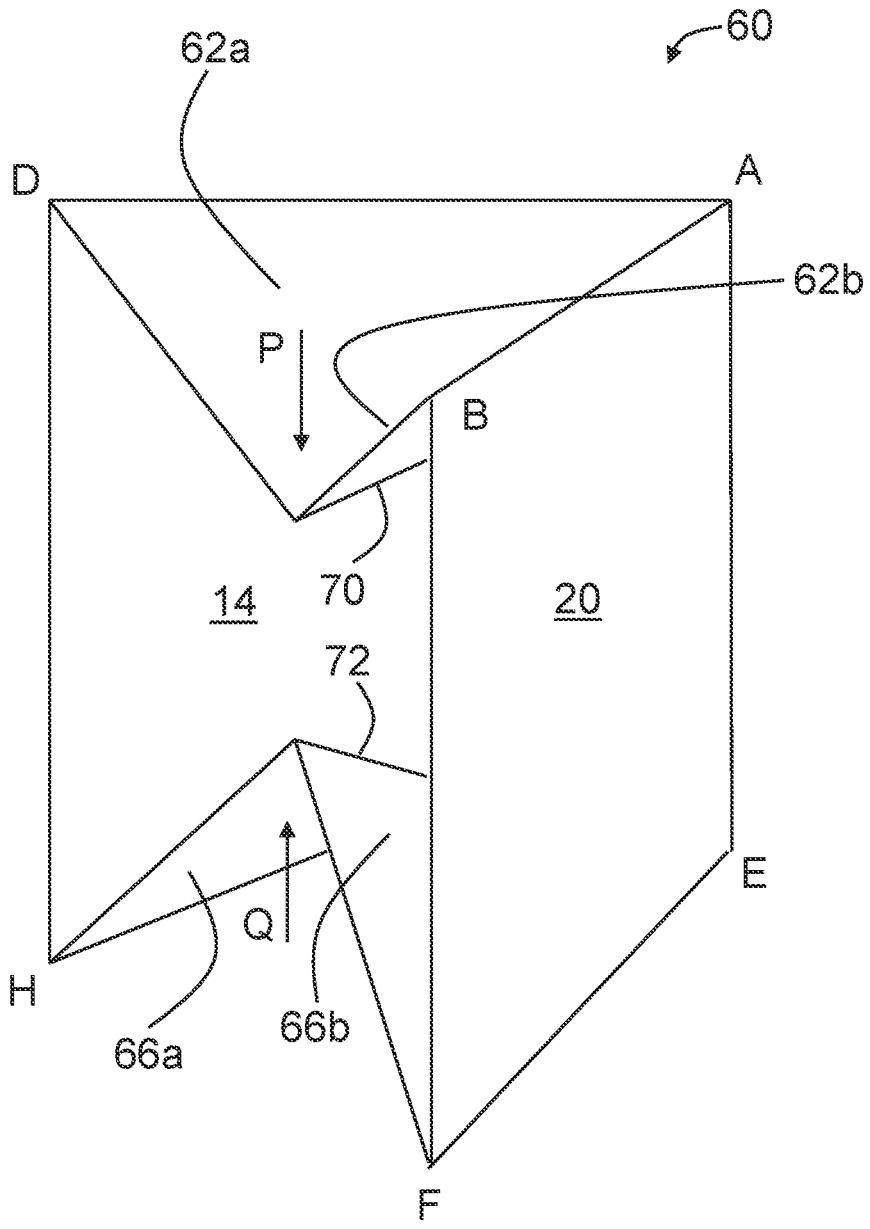

In general, as the first portion 50 collapses (as described above with relation to FIGS. 3-5) and the angle θ1 of FIG. 3 and FIG. 12 decreases, the top face portion 62 folds down along its fold line 70 in the direction of the arrow P in FIGS. 11 and 14 causing the two half portions 62*a*, 62*b* to each fold downward opposingly. Similarly, the bottom face portion 64 folds up along its fold line 72 in the direction of the arrow Q causing the two half portions 64*a*, 64*b* to each fold upward opposingly. A schematic of this is shown in FIG. 13, followed by a top view in FIG. 14 and a front view in FIG. 15.

As the angle θ1 continues to decrease due to the further collapsing of the first portion 50 (as shown in FIGS. 4-5), the angle θ1 decreases from that shown in FIG. 14 to that shown in FIG. 16, and the second portion 60 translates from that shown in FIG. 15 to that shown in FIG. 17. Essentially, the angle θ1 approaches 0°, the sides 14, 20 become opposing face-to-face (shown in both FIG. 5 and FIG. 16), and the top and bottom face portions 62, 64 are each collapsed between the opposing sides 14, 20. Accordingly, FIGS. 16-17 show the second portion 60 in a collapsed state that generally coincides to the collapsed state of the first portion 50 of FIG. 5.

Figure 18:
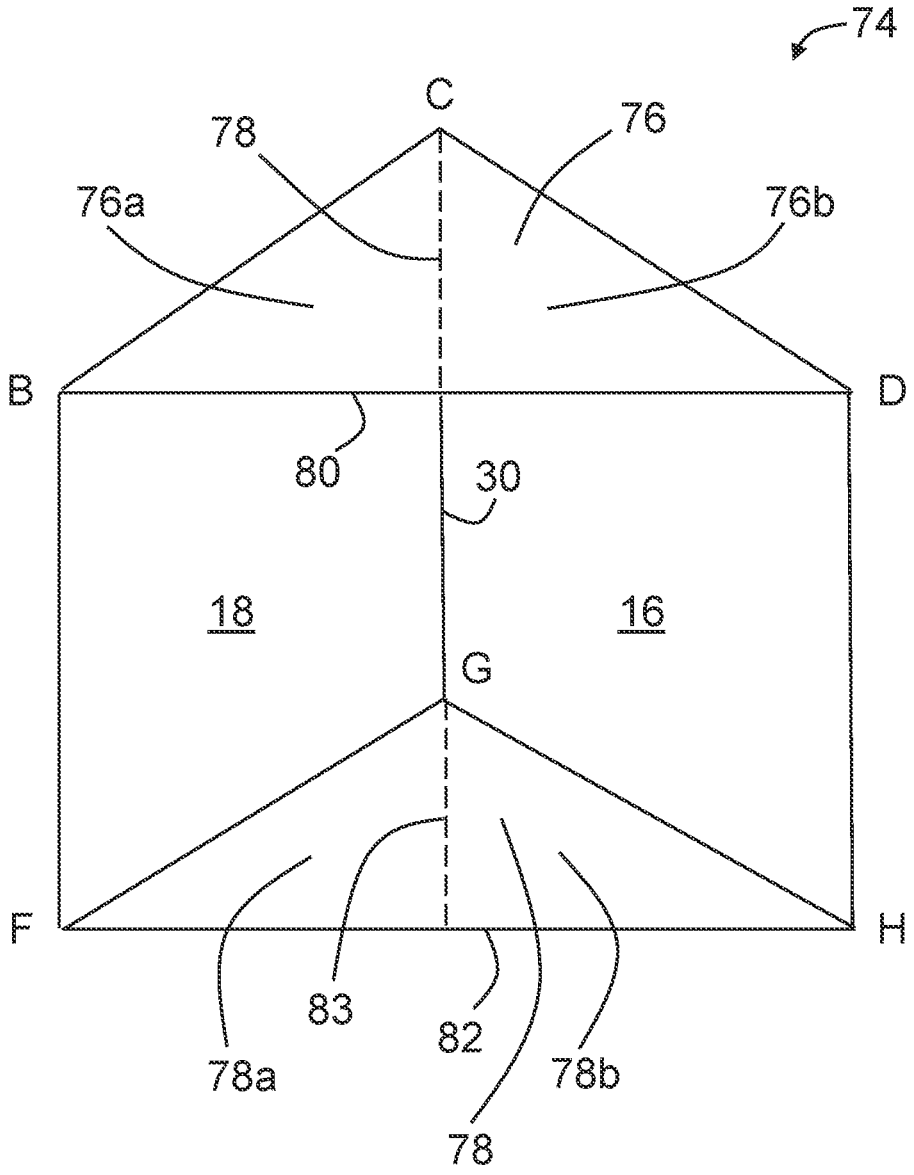
FIG. 18 shows aspects of a third portion of a self-erecting collapsible polyhedron system according to exemplary embodiments hereof.

As shown in FIG. 18, a third portion 74 of the body 12 may be defined comprising side faces 16, 18 joined at edge 30, and including a top face portion 76 and a bottom face portion 78. The top face portion 76 generally includes one-half of the top face 22 resulting from the top face 22 being bisected between vertices B and D to form the middle edge 80, and the bottom face portion 78 generally includes one-half of the bottom face 24 resulting from the bottom face 24 being bisected between vertices F and H to form the middle edge 82. In general, the third portion 74 includes the second half of the system body 12 (with the second portion 60 including the first half).

In some embodiments, as shown in FIG. 18, the third portion 74 is a mirrored equivalent to the second portion 60, and as such, preferably includes all of the core elements and functionalities of the second portion 60 as described herein. For example, the third portion 74 may include top face half portions 76*a*, 76*b* formed by fold line 78 that correspond to top face half portions 62*a*, 62*b* formed by fold line 70 of the second portion 60, and bottom face half portions 78*a*, 78*b* formed by fold line 83 that correspond to bottom face half portions 64*a*, 64*b* formed by fold line 72. Accordingly, to avoid redundancy, the third portion 74 will not be described in further detail.

In some embodiments, the second portion 60 and the third portion 74, when combined to form a cube, generally form the system's body 12 of FIG. 1 while including the top face 22 bisected between the vertices B-D and the bottom face 24 bisected between vertices F-H.

Figure 19:
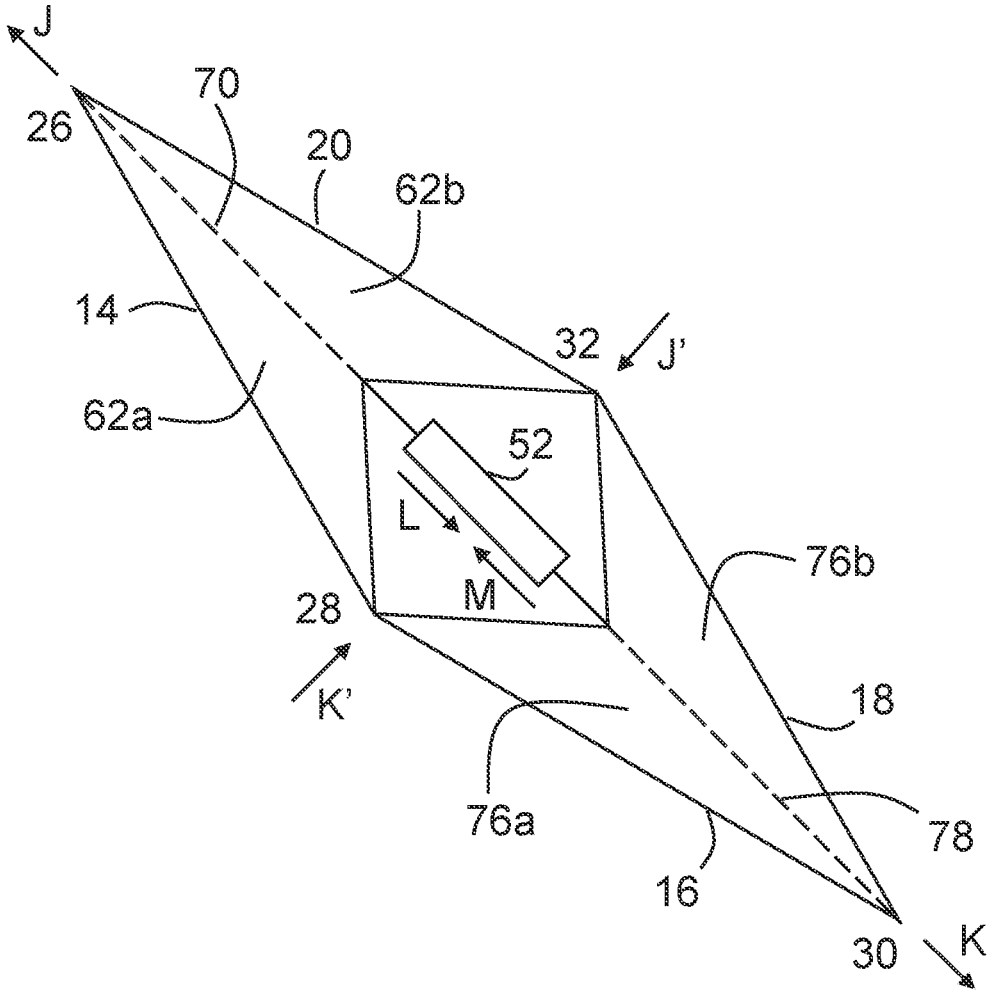
FIGS. 19-20 show aspects of a self-erecting collapsible polyhedron system according to exemplary embodiments hereof.

FIG. 19 shows a top view of the overall system 10 generally comprising the embodiment of FIG. 4 combined with (i) the embodiment of FIG. 14, (ii) the corresponding elements of the third portion 74, and (iii) the embodiment of FIG. 8. In this arrangement, the system 10 includes the combined collapsible functionalities of the first portion 50, second portion 60, and third portion 74, as well as the force mechanism 52.

Figure 20:
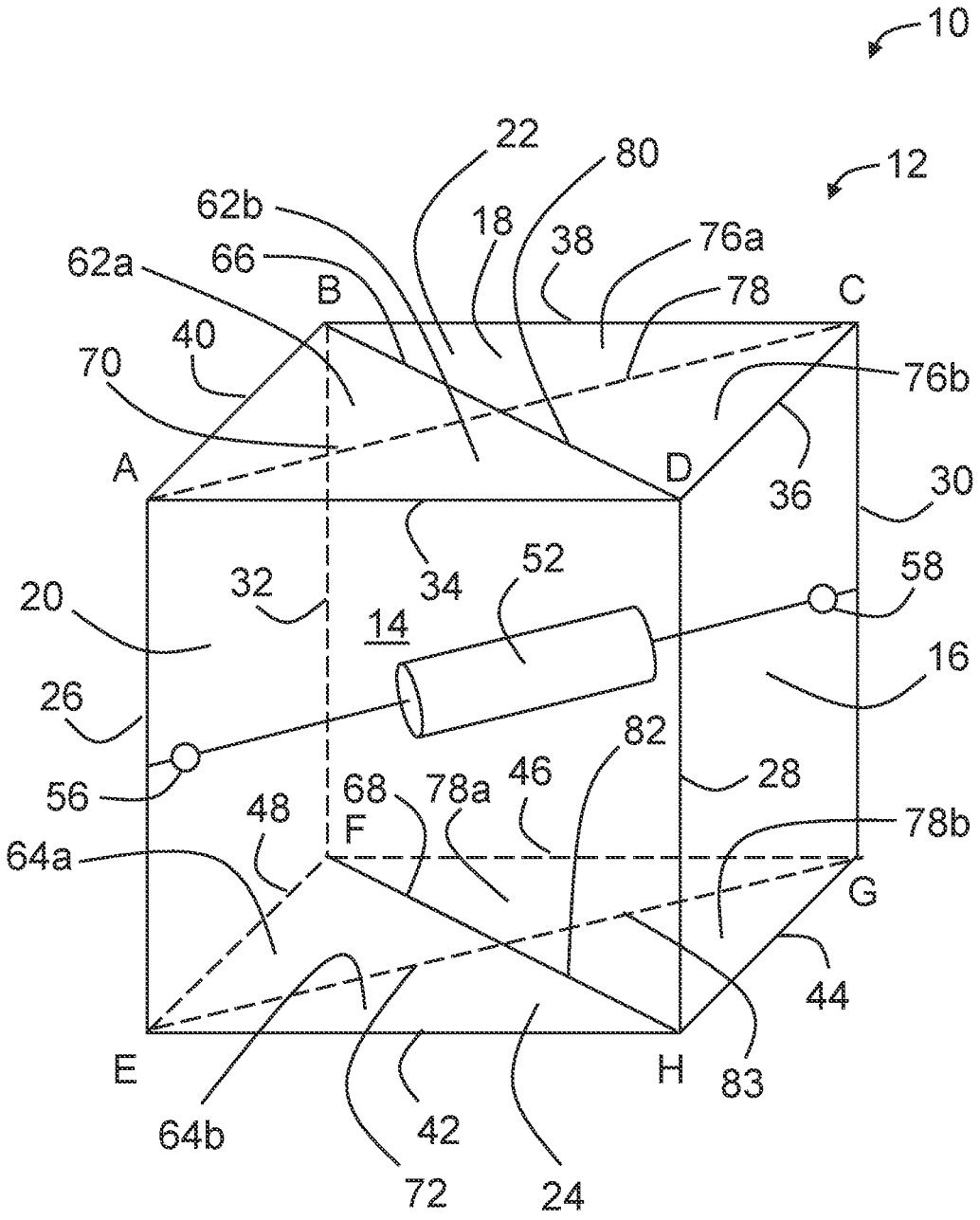

Accordingly, it can be seen that as the force mechanism 52 applies inward forces in the direction of the arrows L, M to the arrangement in FIG. 19, the system 10 may self-erect resulting in the arrangement shown in FIG. 20. In addition, it can be seen that as forces are applied in the direction of arrows J, K (and/or in the directions of J', K') to the arrangement in FIG. 18, the system 10 may further collapse resulting in the arrangement shown in FIG. 5.

In some embodiments, as shown in FIG. 20, when the arrangement forms a cube, the middle edge 66 of the top face portion 62 may engage the middle edge 80 of the top face portion 76 thereby providing a stop to the forces applied in the directions of the arrows L, M by the force mechanism 52. Although not shown, it is understood that the lower middle edges 68, 82 also may engage providing an additional stop to the forces applied by the force mechanism 52 on the bottom side of the system 10. Accordingly, the stops ensure that once the system 10 self-erects into a cubical form, the self-erecting stops. This enables the system 10 to self-erect from a generally collapsed configuration to a fully erected cube.

In addition, it can be seen that forces applied to the cubic system 10 of FIG. 19 in the directions of the arrows J, K and/or J', K' may cause the system 10 to collapse as described herein. In some embodiments, this action may be performed manually by a user of the system 10.

Figure 21:
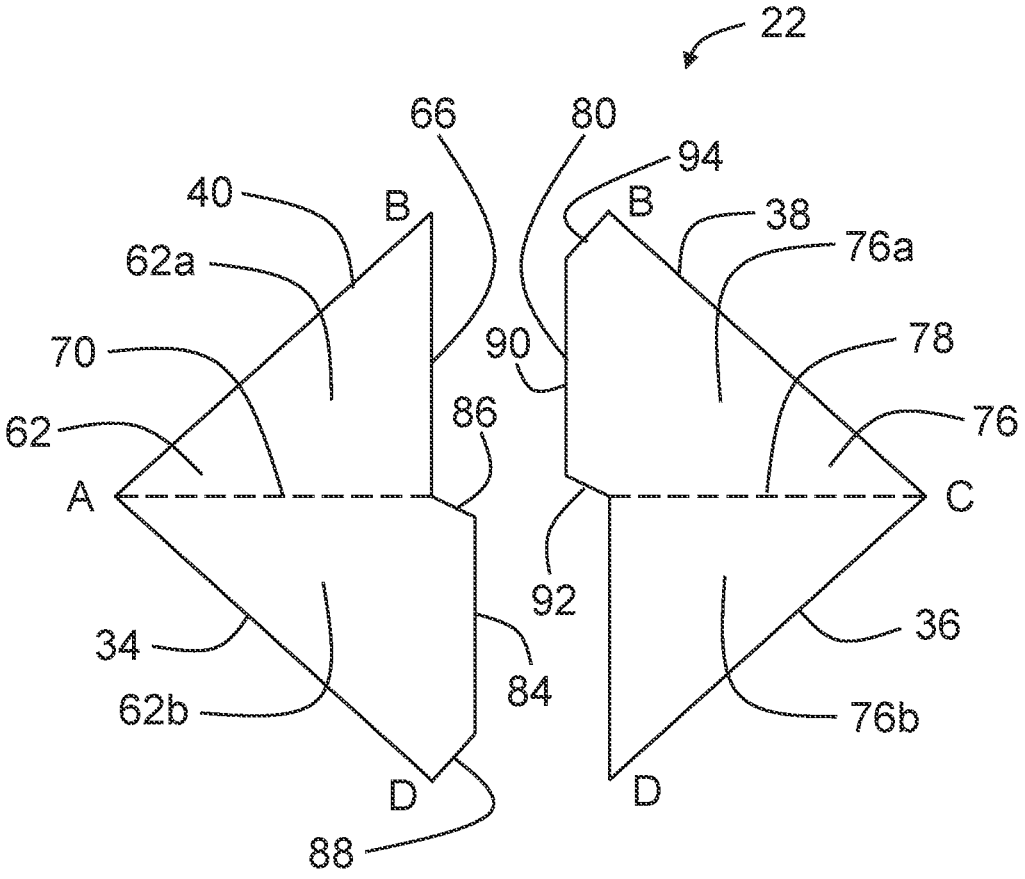
FIG. 21 shows aspects of a top face of a self-erecting collapsible polyhedron system according to exemplary embodiments hereof.

FIG. 21 shows the top face 22 divided into the top face portion 62 and top face portion 76 and separated for clarity. In some embodiments, as shown in FIG. 21, the upper middle edge 66 includes a tab 84 extending from the vertex D to the fold line 70 and including a left chamfer 86 and a right chamfer 88. Similarly, the upper middle edge 80 includes a tab 90 extending from the vertex B to the fold line 78 and including a left chamfer 92 and a right chamfer 94.

Figure 22:
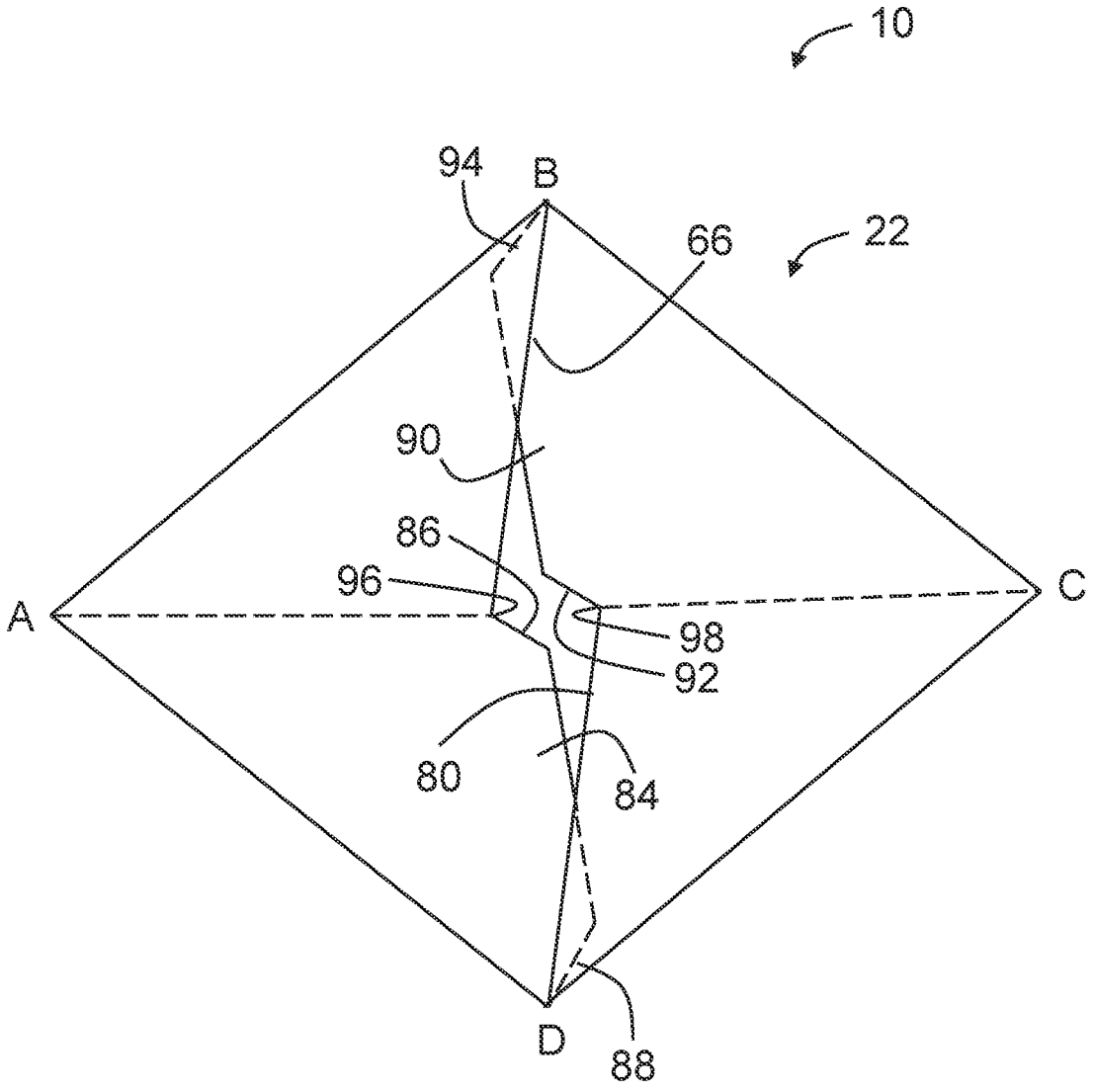
FIGS. 22-23 show aspects of a self-erecting collapsible polyhedron system according to exemplary embodiments hereof.

FIG. 22 shows a top view of the system 10 and the top face 22 of FIG. 21 resulting from the body 12 being in a partially collapsed state (similar to FIG. 4). As shown the left chamfer 86 forms a first notch 96 and the left chamfer 92 forms a second notch 98. In some embodiments, the first notch 96 and the second notch 98 are adapted to receive one another in an overlapping notching configuration when the system 10 self-erects into a cubical form a shown in FIG. 23. In this way, the abutting notches 96, 98 provide automatically interlocking stops to the system 10 when the system 10 self-erects into a cubical form. It is notable that the right chamfer 94 of the tab 90 is adapted to be automatically positioned underneath the middle edge 66, and that the right chamfer 88 is adapted to be automatically positioned underneath the middle edge 80 as the system's body 12 translates from a collapsed state to a fully erected state. In this way, the tab 90 is automatically positioned underneath the middle edge 66 and the tab 84 is automatically positioned underneath the middle edge 80 as the system 10 self-erects, causing the notches 96, 98 to automatically engage one another to form the stop.

Figure 23:
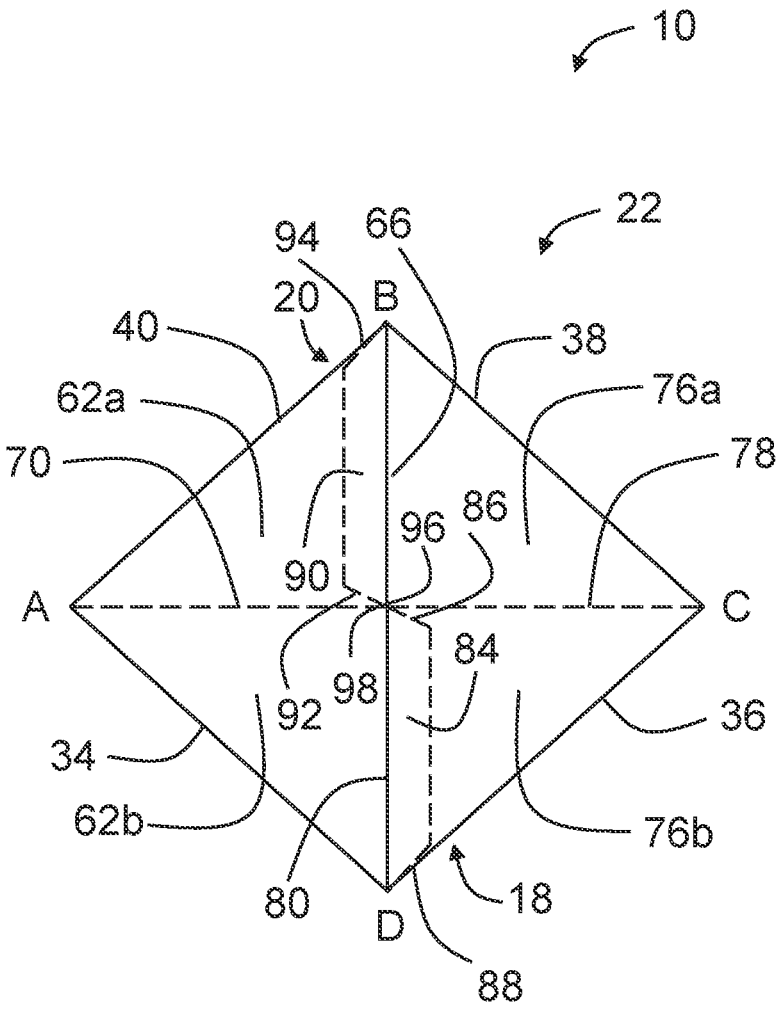

In some embodiments, as shown in FIG. 23, the right chamfer 88 is adapted to abut against the inner surface of the face 18 and the right chamfer 94 is adapted to abut against the inner surface of the face 20 when the system 10 self-erects into a cubical form. In this way, the abutting chamfer 88, 94 and face 18, 20 interfaces, respectively, provide stops to the system 10 when the system 10 self-erects into a cubical form.

Although not shown, it is understood that the bottom face portions 64 and 78 also include similar tabs, left chamfers, right chamfers, and notches configured similarly to function as automatically interlocking stops to the system 10 on the bottom side when the system 10 self-erects into a cubical form.

In some embodiments, the outer surfaces of the faces 14, 16, 18, 20, 22, 24 are adapted to receive images (e.g., photographic reproductions), graphics, and text to be printed onto the faces 14, 16, 18, 20, 22, 24 to form a three-dimensional graphical cube that may be used for a variety of purposes. In one implementation, the graphical cube may be used as a three-dimensional greeting card. The three-dimensional greeting card (the box) may be collapsed and placed into an envelope, and upon being removed from the envelope, may automatically self-erect providing a fun and exciting experience. Multiple systems 10 may be placed into an envelope together at one time. Confetti also may be included within the system 10 that may be ejected during the system 10 self-erecting, thereby providing even more enjoyment. In some embodiments, the confetti may be placed into the folded fold lines 70, 78, 72, 83 to be ejected as the fold lines translate from a fully folded configuration to a fully opened configuration during the self-erecting of the system 10.

In some embodiments, the system 10 includes a holder 100 adapted to generally hold the system 10 in a collapsed state (e.g., flattened) to assist in placing the collapsed system 10 and in removing the collapsed system 10 from the envelop.

Figure 24:
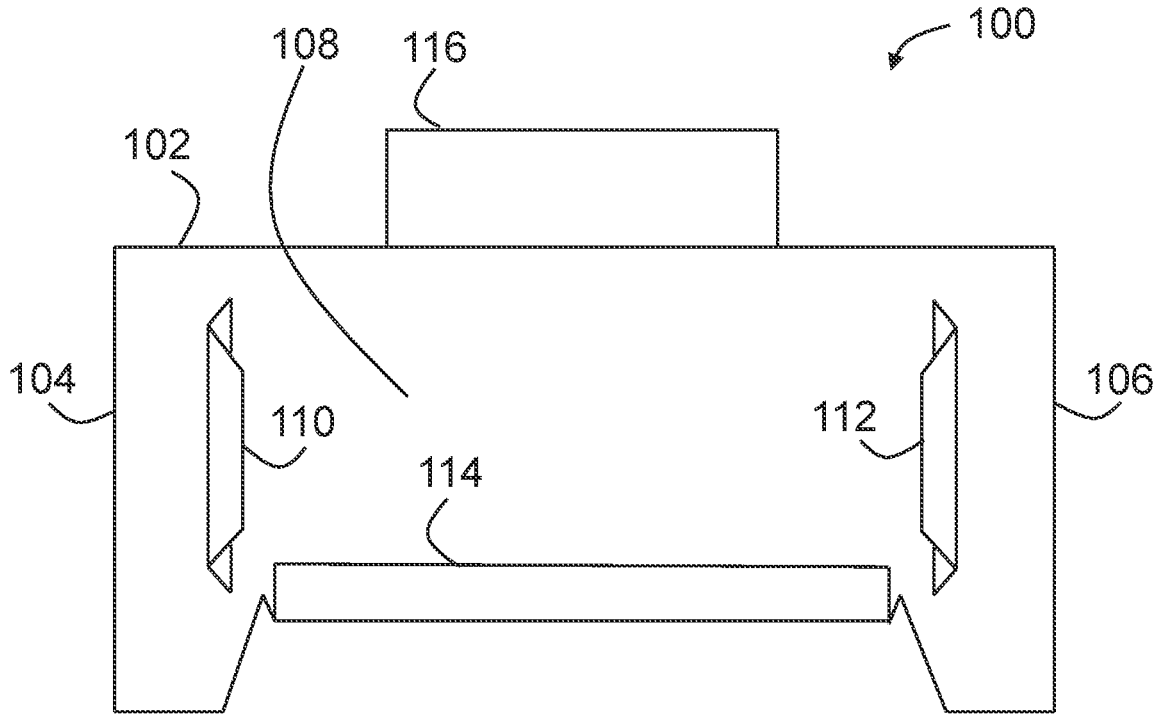
FIG. 24 shows a holder for a self-erecting collapsible polyhedron body according to exemplary embodiments hereof.

In some embodiments, as shown in FIG. 24, the holder 100 includes a substrate 102 (e.g., a cardboard card) including a left side 104, a right side 106, and a back base surface 108 extending between the left side 104 and the right side 106. The holder 100 also includes a first holding tab 110 extending outward from the back base surface 108 and located towards the left side 104, a second holding tab 112 extending outward from the back base surface 108 and located towards the right side 106, and a generally horizontal tray 114 extending outward from the back base surface 108 and located generally below the left and right holding tabs 110, 112, respectively. The holder 100 also includes a top tab 116 extending upward from the substrate 102

Figure 25:
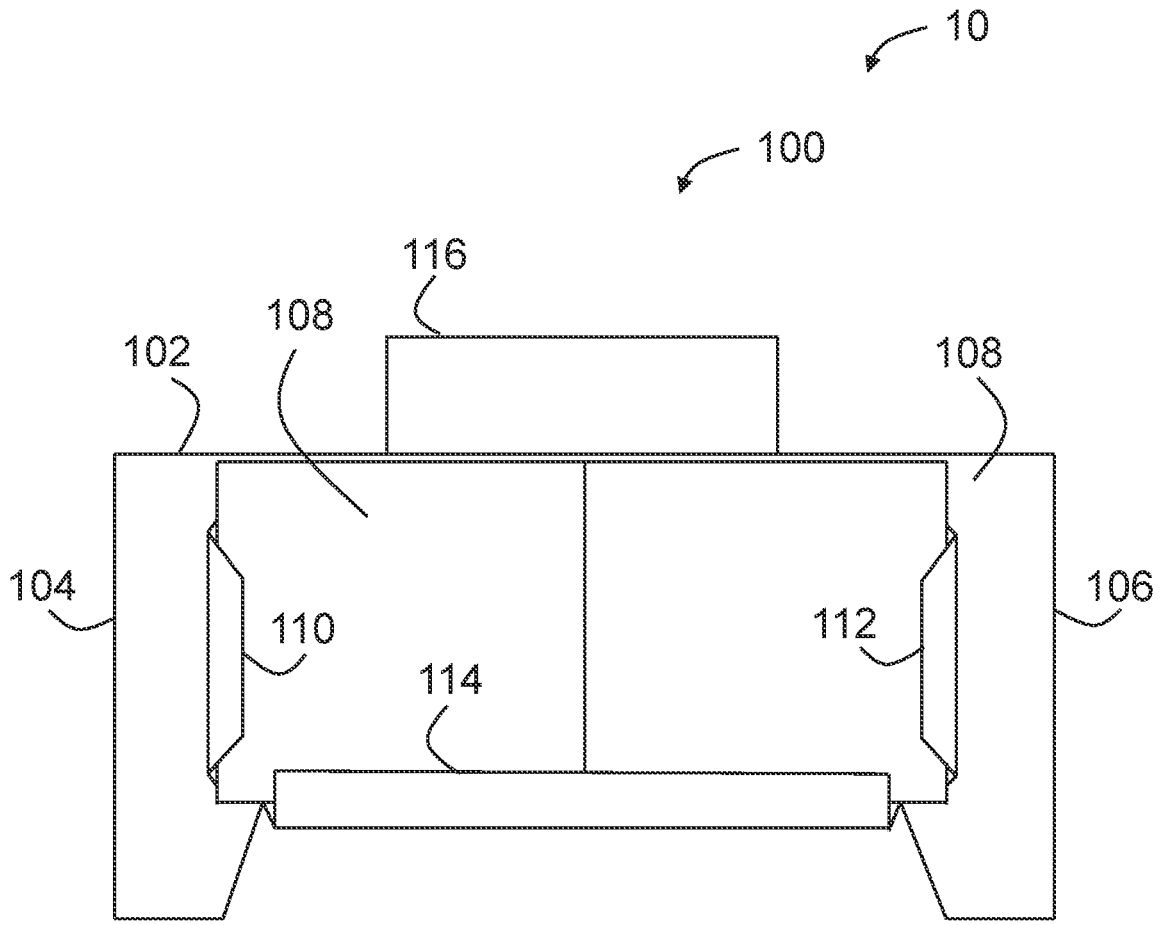
FIG. 25 shows a self-erecting collapsible polyhedron system including a self-erecting collapsible polyhedron body held within the holder of FIG. 24 according to exemplary embodiments hereof.

In some embodiments, as shown in FIG. 25, the system 10, when collapsed as described herein, is placed against the back base 108 with the collapsed system's left side tucked within and held by the first holding tab 110, the collapsed system's right side tucked within and held by the second holding tab 112, and the collapsed system's bottom side tucked within and held by the tray 114.

In some embodiments, the holder 100 is sized to fit within a flat envelop thereby holding the collapsed system 10 in a collapsed state between the holder's back base surface 108 and the inner front side surface of the envelop.

In some embodiments, with the holder 100 holding the collapses system 10 within the envelop, the holder's top tab 116 is accessible when the envelop is opened such that a user may grasp the top tab 16 and pull the holder 100 and collapsed system 10 upwards and out of the envelop. Once the holder 100 and the collapses system 10 clear the front of the envelop and the system 10 is no longer held in its collapsed state, the force mechanism 52 causes the system 10 to self-erect as described herein providing a startling and fun experience to the user.

Figure 26:
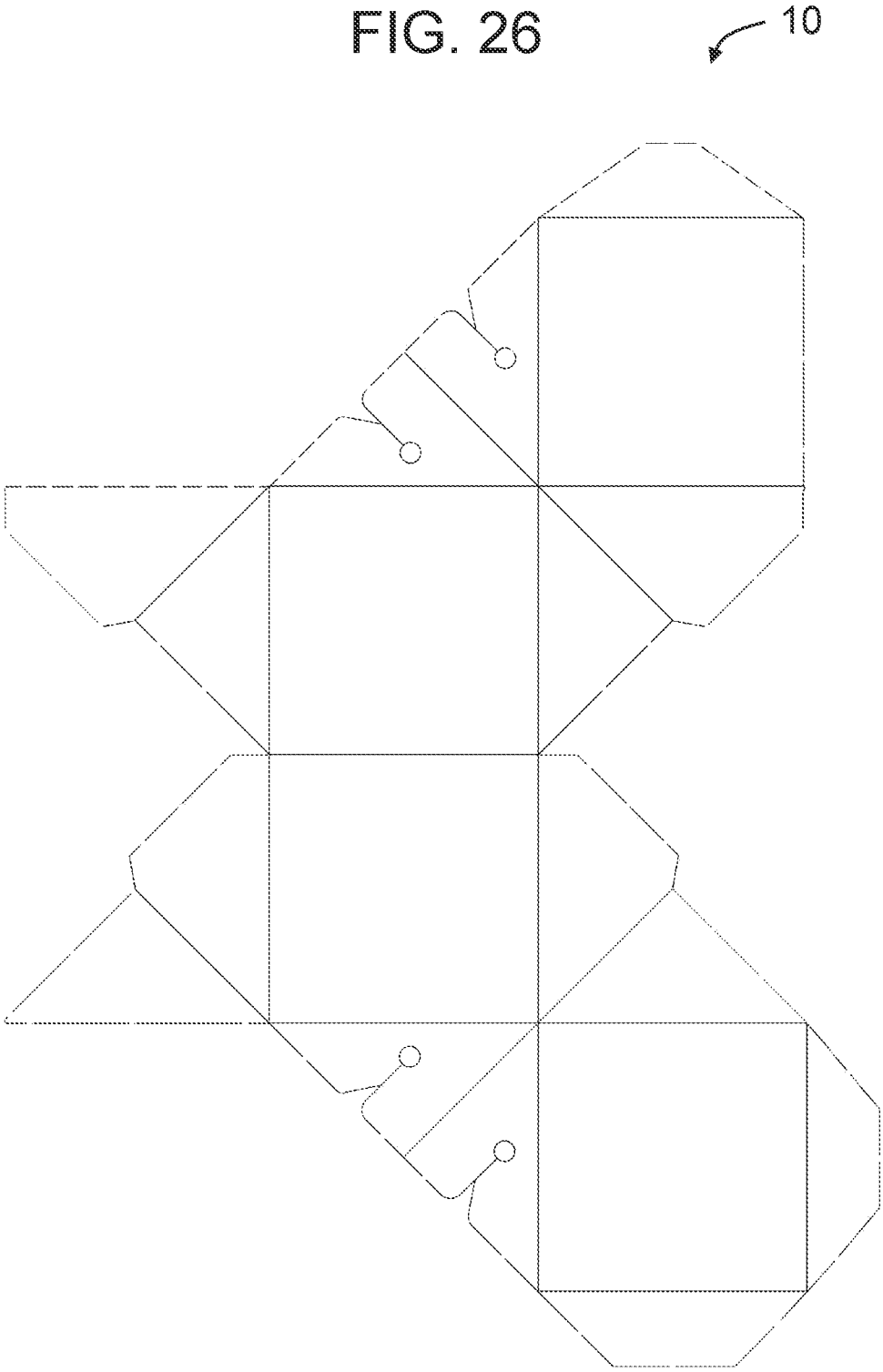
FIG. 26 shows a dieline of a self-erecting collapsible body according to exemplary embodiments hereof.

FIG. 26 shows an exemplary dieline for the polyhedron body 12.

It is understood that any details and/or aspects of any embodiments described herein may be combined with any details and/or aspects of any other embodiments in any way to form additional embodiment(s) all of which are within the scope of the filter system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A self-erecting box system comprising:

a hollow cuboid adapted to transition from a collapsed configuration to an erected cuboid-shaped configuration and/or from the erected cuboid-shaped configuration to the collapsed configuration, the cuboid including a top face, a bottom face, a first side face, a second side face, a third side face, and a fourth side face defining an inner volume, a first edge formed between the first and second faces, a second edge formed between the second and third faces, a third edge formed between the third and fourth faces, and a fourth edge formed between the fourth and first faces;

an elastic member with a first end coupled to the second edge and a second end opposite the first end coupled to the fourth edge and applying an inward force to the second edge and to the fourth edge;

the top face including a first top portion and a second top portion adapted to physically separate from one another about a first dividing line extending across the top face from the first edge to the third edge;

the bottom face including a first bottom portion and a second bottom portion adapted to physically separate from one another about a second dividing line extending across the bottom face from the first edge to the third edge; and the first dividing line parallel to the second dividing line when the cuboid is in the erected cuboid-shaped configuration.

2. The self-erecting box system of claim 1 wherein the first, second, third, and fourth edges are flexible enabling the hollow cuboid to transition from an erected cuboid-shaped configuration to a collapsed configuration.

3. The self-erecting box system of claim 1 wherein when the hollow cuboid transitions from the erected cuboid-shaped configuration to the collapsed configuration, an angle at the fourth edge between the first and fourth faces transitions from substantially 90° to substantially 0°, and an angle at the first edge between the first and second faces transitions from substantially 90° to substantially 180°.

4. The self-erecting box system of claim 1 wherein when the hollow cuboid transitions from the erect configuration to the collapsed configuration, the first and second top portions separate from one another at the first dividing line and/or the first and second bottom portions separate from one another at the second dividing line.

5. The self-erecting box system of claim 1 wherein when the hollow cuboid is in the collapsed configuration, the inward force applied by the elastic member causes the hollow cuboid to transition from the collapsed configuration to the erect configuration.

6. The self-erecting box system of claim 1 wherein when the hollow cuboid transitions from the collapsed configuration to the erect configuration, the first dividing line acts as a first stop between the first and second top portions and/or the second dividing line acts as a second stop between the first and second bottom portions.

7. The self-erecting box system of claim 1 wherein the first top portion includes a first notch with a first notch apex at the first dividing line and the second top portion includes a second notch with a second notch apex at the first dividing line, and wherein the first and second notch apexes physically engage with one another when the hollow cuboid is in the erect configuration.

8. The self-erecting box system of claim 1 further comprising:

a holder including a back surface and a tray, the holder adapted to receive the hollow cuboid when the hollow cuboid is in the collapsed configuration.

9. The self-erecting box system of claim 8 wherein the holder further comprises a left holding tab and a right holding tab, the left and right holding tabs adapted to receive the hollow cuboid when the hollow cuboid is in the collapsed configuration.

10. The self-erecting box system of claim 8 further comprising an envelope adapted to receive the holder and the hollow cuboid in the collapsed configuration and to secure the holder and the hollow cuboid in the collapsed configuration.

11. The self-erecting box system of claim 1 wherein the first edge, the second edge, the third edge, and the fourth edge are all parallel with one another when the cuboid is in the erected cuboid-shaped configuration and when the cuboid is in the collapsed configuration.

12. The self-erecting box system of claim 1 wherein the first edge, the second edge, the third edge, and the fourth edge all remain parallel with one another as the cuboid transitions from the erected cuboid-shaped configuration to the collapsed configuration.

13. The self-erecting box system of claim 1 wherein the first side face, the second side face, the third side face, and the fourth side face are each square and completely flat when the cuboid is in the erected cuboid-shaped configuration and when the cuboid is in the collapsed configuration.

14. The self-erecting box system of claim 1 comprising a total of one elastic member and wherein the elastic member applies a first inward force to the second edge and a second inward force to the fourth edge and wherein the first and second inward forces are applied along a common axis and wherein the common axis is perpendicular to the first dividing line and to the second dividing line.

15. A self-erecting box system comprising:

a hollow cuboid adapted to transition from a collapsed configuration to an erected cuboid-shaped configuration and/or from the erected cuboid-shaped configuration to the collapsed configuration, the cuboid defined by a top face, a bottom face, a first side face, a second side face, a third side face, and a fourth side face defining an inner volume, a first edge formed at a first intersection between the first and second faces, a second edge formed at a second intersection between the second and third faces, a third edge formed at a third intersection between the third and fourth faces, and a fourth edge formed at a fourth intersection between the fourth and first faces;

an elastic member including a first end coupled to the second edge and a second end coupled to the fourth edge, the elastic member extending across the inner volume between the second edge and the fourth edge and applying an inward force to the first edge and the second edge;

wherein when the hollow cuboid is in the collapsed configuration, the inward force applied by the elastic member causes the hollow cuboid to transition from the collapsed configuration to the erected cuboid-shaped configuration; and wherein the first edge, the second edge, the third edge, and the fourth edge are all parallel with one another when the cuboid is in the erected cuboid-shaped configuration and when the cuboid is in the collapsed configuration.

16. The self-erecting box system of claim 15 wherein the top face includes a first top portion and a second top portion adapted to separate from one another about a first dividing line extending across the top face from the first edge to the third edge, and the bottom face includes a first bottom portion and a second bottom portion adapted to separate from one another about a second dividing line extending across the bottom face from the first edge to the third edge.

17. The self-erecting box system of claim 15 wherein the top face includes a first top portion and a second top portion adapted to physically separate from one another about a first dividing line extending across the top face from the first edge to the third edge, the bottom face includes a first bottom portion and a second bottom portion adapted to physically separate from one another about a second dividing line extending across the bottom face from the first edge to the third edge, and the first dividing line is parallel to the second dividing line when the cuboid is in the erected cuboid-shaped configuration.

18. The self-erecting box system of claim 15 wherein the first edge, the second edge, the third edge, and the fourth edge all remain parallel with one another as the cuboid transitions from the erected cuboid-shaped configuration to the collapsed configuration.

19. The self-erecting box system of claim 15 wherein the first side face, the second side face, the third side face, and the fourth side face are each square and completely flat when the cuboid is in the erected cuboid-shaped configuration and when the cuboid is in the collapsed configuration.

20. The self-erecting box system of claim 15 wherein the elastic member applies a first inward force to the second edge and a second inward force to the fourth edge and wherein the first and second inward forces are applied along a common axis and wherein the common axis is perpendicular to the first dividing line and to the second dividing line.

* * * * *